United States Patent [19]

Mancinelli et al.

[11] Patent Number: 4,503,628

[45] Date of Patent: Mar. 12, 1985

[54] SHOE INSERT

[76] Inventors: Ralph A. Mancinelli, 2305 Hayes, East Detroit, Mich. 48021; Anthony R. Mancinelli, 39330 Donahue, Mt. Clemens, Mich. 48044

[21] Appl. No.: 400,135

[22] Filed: Jul. 20, 1982

[51] Int. Cl.[3] ..... A43B 23/28

[52] U.S. Cl. ..... 36/58.6; 36/68; 36/69

[58] Field of Search ..... 36/136, 58.5, 68, 80, 36/70 R, 72 B, 73, 58.6, 69; 223/118, 119

[56] References Cited

U.S. PATENT DOCUMENTS

| | | | |
|---|---|---|---|
| 277,614 | 4/1883 | Roosevelt | 36/68 X |
| 1,012,253 | 12/1911 | Gerhart | 36/68 |
| 1,176,572 | 3/1916 | Lassig | 36/136 |
| 2,088,976 | 8/1937 | Resnik | 36/68 |
| 2,319,356 | 5/1943 | Sullivan | 36/68 |
| 2,366,097 | 12/1944 | Gesell | 223/118 |
| 2,661,549 | 12/1953 | Lindner et al. | 36/68 |
| 3,112,571 | 12/1963 | Musgrave | 36/58.6 |

FOREIGN PATENT DOCUMENTS

| | | | |
|---|---|---|---|
| 1303149 | 1/1973 | United Kingdom | 2/105 |

*Primary Examiner*—Werner H. Schroeder
*Assistant Examiner*—Mary A. Ellis
*Attorney, Agent, or Firm*—Harvey B. Jacobson

[57] ABSTRACT

An insert for the heel portion of a shoe in the form of a generally U-shaped, stiff but flexible plastic sheet member for conforming with and engaging the inner surface of the quarter portion of the shoe upper and extending from the heel seat to the upper edge of the quarter or vamp in those constructions in which the vamp extends partially above the heel quarter. The sheet member includes double faced adhesive strips to secure the insert securely in position within the shoe to prevent relative movement between the insert and shoe when the shoe is worn during normal activities such as walking. The sheet member includes a reversely curved top edge which extends outwardly and downwardly and overlies and receives the upper edge of the quarter portion or vamp depending upon the type of shoe construction. This reversely formed edge rigidifies and reinforces the sheet member and the adjacent portion of the shoe upper and also provides a continuous, smooth surface for engagement by the heel area of the foot and sock when the foot is being inserted into the shoe, especially a slip on type shoe, thereby enabling the shoe to be readily placed on the foot without the use of a shoe horn or other aid and without the quarter portion of the shoe upper being folded inwardly and downwardly as may occur when placing the foot into slip on shoes without a shoe horn or other inserting aid. The lower edge of the sheet member is provided with parallel lines to provide a guide for cutting off the lower edge of the sheet member with a pair of scissors or the like so that the vertical height of the sheet member may be varied for use with different sizes of shoes.

3 Claims, 4 Drawing Figures

Fig. 1
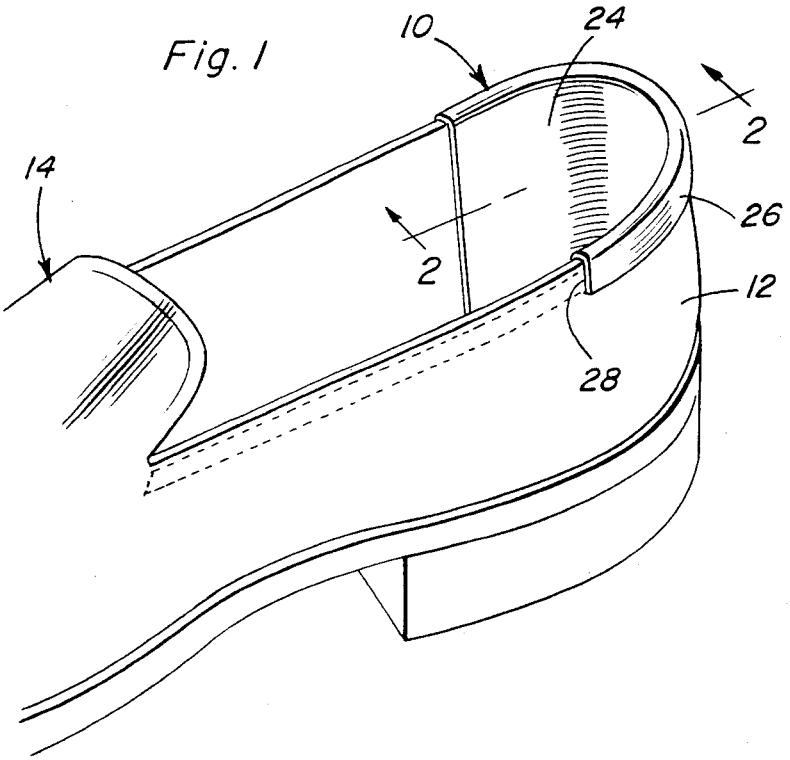
Fig. 4
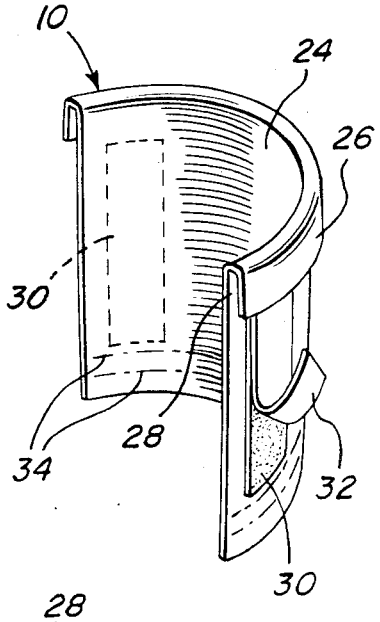
Fig. 2
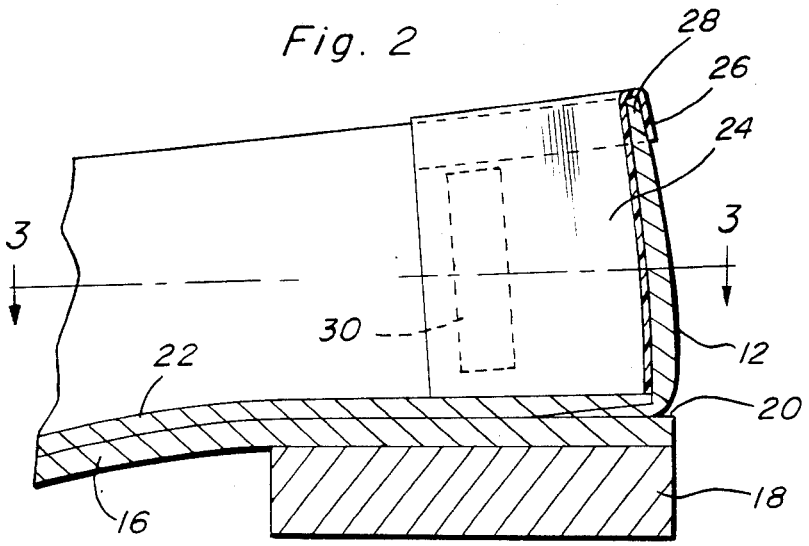
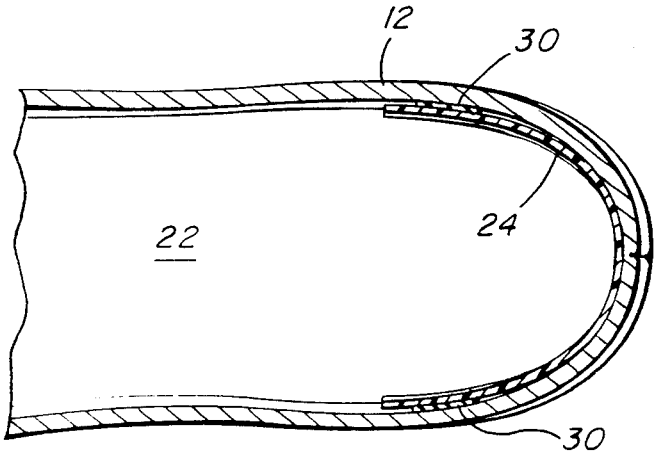
Fig. 3

SHOE INSERT

BACKGROUND OF THE INVENTION

1. Field of the Invention

The present invention generally relates to a shoe insert and more particularly to a stiffening and reinforcing insert for the heel engaging area or quarter portion of the shoe upper to facilitate movement of the foot into the shoe without the quarter portion of the shoe upper being rolled over and inwardly as frequently occurs especially when placing a shoe of the slip on type onto the foot of a wearer.

2. Description of the Prior Art

Shoes are provided with uppers which enclose the foot and various procedures have been adapted to enable the shoe to be placed on the foot and securely retained thereon. Included in the efforts to facilitate insertion of a foot into a shoe is the provision of various shoe horns and other similar aids. While such devices perform satisfactorily, they quite frequently are not available when their use if desired which has resulted in people using their fingers to assist in the insertion of the foot into a shoe or merely forcing the foot into the shoe and working the shoe back and forth until it slips on the foot. This frequently results in the upper edge portion of the heel quarter or vamp of the shoe upper being rolled forwardly and downwardly. When this action is repeated numerous times, it will damage the quarter portion of the shoe upper since it becomes flexible rather than being substantially rigid which is necessary to properly retain the shoe upper in proper shape. This problem is especially prevalent in slip on type shoe constructions.

SUMMARY OF THE INVENTION

An object of the present invention is to provide a shoe insert which is oriented interiorly of the quarter portion of the shoe upper and is of generally U-shaped configuration to conform with the interior heel engaging surface of the quarter portion of the shoe upper and includes a downwardly opening channel which overlies and telescopically receives the upper edge of the quarter portion of the shoe upper to stiffen and reinforce the quarter portion or heel engaging area of the shoe upper and facilitate insertion of a wearer's foot into the shoe.

Another object of the invention is to provide a shoe insert in accordance with the preceding object in which adhesive means is provided to secure the shoe insert permanently in the shoe and to prevent relative movement between the shoe insert and shoe while the shoe is being worn during normal activity such as walking, running and the like.

A further object of the invention is to provide a shoe insert in accordance with the preceding objects in which the insert is constructed of a pre-formed, one piece sheet member of plastic material being relatively stiff but still somewhat flexible so that it can conform with shoes having slightly different interior dimensional characteristics with the top edge of the sheet member being reversely formed to provide a downwardly opening groove or channel which telescopically receives the upper edge of the heel engaging area of the shoe upper with the lower edge of the sheet member being positioned adjacent the heel seat or insole overlying the heel seat.

Still another object of the invention is to provide a shoe insert in accordance with the preceding objects in which the lower edge of the insert is provided with parallel guide lines to facilitate the sheet member being cutoff along the lower edge to enable the insert to be used with various sizes of shoes which have different heighth dimensions from the heel seat to the upper edge of the quarter portion of the shoe upper.

A still further object of the invention is to provide a shoe insert which is simple in construction, easy to install and effectively stiffens, reinforces and protects the quarter portion or heel engaging area of the shoe upper to facilitate the movement of a wearer's foot into the shoe without the use of a shoe horn and without such movement rolling the upper edge of the shoe quarter forwardly and downwardly as frequently occurs when forcing a foot into the shoe without a shoe horn or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a shoe with the insert of the present invention inserted into the quarter of the shoe upper.

FIG. 2 is a vertical sectional view taken substantially upon a plane passing along section line 2—2 of FIG. 1 illustrating the relationship of the shoe insert to the shoe upper.

FIG. 3 is a transverse, sectional view taken substantially upon a plane passing along section line 3—3 of FIG. 2 illustrating further relationships between the shoe insert and quarter of the shoe upper.

FIG. 4 is a perspective view of the shoe insert illustrating the double faced adhesive tape with the protective covering being partially removed.

DESCRIPTION OF THE PREFERRED EMBODIMENT

Referring now specifically to the drawings, the shoe insert of the present invention is generally designated by the reference numeral 10 and is specifically adapted to be placed interiorly of the quarter portion 12 or heel engaging area of a shoe upper generally designated by numeral 14 in which the shoe upper is of conventional construction and provided with the usual outsole 16, heel 18 with a heel seat 20 and an insole 22. The quarter portion 12 of the shoe upper 14 is subject to forward deflection or rolling when a person inserts his foot into the shoe. Conventionally, this deflection of the shoe quarter 12 is prevented by the use of shoe horns or similar aids which are inserted between the heel of the wearer and the upper edge of the shoe quarter 12 when the wearer inserts his foot into the shoe. However, when shoe horns are not available or in situations where shoe horns are not used, the repeated forward bending and folding of the top edge of the shoe quarter damages this area of the shoe upper and leads to the stitched components forming the quarter and shoe upper becoming separated, damaged and the like resulting in a reduction in the useful life of the shoe.

The shoe insert 10 includes a sheet member 24 of substantially rigid but still somewhat flexible plastic material which is of one piece construction and formed with a U-shaped configuration when observed from the top as illustrated in FIG. 3 so that it conforms with and engages the interior surface of a substantial portion of the heel engaging area or quarter 12 of the shoe so that the two forward vertical edges are spaced substantially forward from the central vertical web portion of the sheet member as illustrated in FIG. 3 and the sheet member 24 extends vertically throughout the length of the quarter portion 12 of the shoe upper 14 as illustrated in FIG. 2. The upper edge of the sheet member is provided with a reversely formed flange 26 which defines a downwardly facing channel or groove 28 around the upper edge of the sheet member 24 so that when the sheet member 24 is inserted into the shoe in engagement with the inner surface of the quarter portion 12 thereof, the channel 28 will telescopically receive and frictionally engage the upper edge of the shoe quarter portion or heel engaging area 12 as illustrated in FIG. 2 thus securely reinforcing and stiffening this area of the shoe upper and providing a continuous, smooth and reduced friction surface for engagement by the foot and sock of a wearer when the wearer inserts his foot into the shoe without using a shoe horn or the like thereby facilitating the insertion of the foot into a shoe, particularly a shoe of the slip on type.

The external surface of the sheet member 24 is provided with a pair of vertically disposed double faced adhesive strips 30 which are provided with a protective cover 32 that is removed when the insert is placed in the shoe. Thus, by removing the protective covers 32 and squeezing the free edges of the sheet member 24 towards each other, the device may be inserted into the shoe and the channel 28 fitted over the upper edge of the heel engaging area 12 after which the edges of the sheet member 24 may be released and forced outwardly to securely engage the pressure sensitive adhesive tape strips 30 with the interior surface of the shoe quarter portion 12 for permanently mounting the insert in place to prevent relative movement between the shoe insert and shoe upper during use of the shoe but yet permitting removal of the insert when desired for replacement or the like.

The flexibility of the sheet member 24 enables it to be used with shoes of different size insofar as the curvature of the shoe quarter portion 12 is concerned and the lower edge of the sheet member is provided with one or more indicating lines 34 to provide guides by which the lower edge of the sheet member 24 may be severed by the use of scissors, a knife or the like thereby accommodating different shoe sizes in which the vertical heighth of the quarter portion 12 or heel engaging area of the shoe upper is different thereby enabling the shoe insert to be used with various sizes of shoes.

The plastic material from which the shoe insert is molded is preferably polyethylene although other equivalent plastics may be used. The reversely folded flange 26 and channel 28 formed thereby has a free edge which extends downwardly over the top edge of the shoe quarter 12 a short distance, on the order of $\frac{1}{4}$ inch so that it will not be noticeable. The tape strips 30 are also relatively thin such as 1/32 inch in thickness. The shoe insert can be used with shoes of a size to fit small children or adults and substantially reinforces the back leather of the heel preventing it from folding over thus eliminating the use of shoe horns and prolongs the useful life of the shoe. The device is in the form of a permanent installation and can be used on new or old shoes and does not interfere with a person's walking or cause any blistering of a person's heel. The polyethylene plastic material is a soft grade which can be altered to fit the heel of the shoe with a pair of scissors and is resistant to water and all chemicals and is similar to the type of plastic used in bottles or receptacles for various liquid materials and the like. Also, the shoe insert can be used with various types of shoes that may be used for work, play, such as golf shoes, tennis shoes, basketball shoes and the like as well as dress shoes and is particularly useful in shoes of the slip on type although it can be used with those having laced or buckled uppers.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An insert for the interior of the quarter portion or heel engaging area of a shoe upper for stiffening the shoe upper and facilitating insertion of a foot into the shoe without the use of a shoe horn and the like, said insert comprising a thin sheet member having a U-shaped horizontal cross-sectional configuration and a vertical dimension generally equal to the heighth of a quarter portion of a shoe upper and means securing the sheet member contiguous with the inner surface of the quarter portion of the shoe for stiffening the quarter portion of the shoe upper, said securing means including an outwardly and downwardly turned top edge on said sheet member to receive the top edge of the quarter portion of a shoe upper to rigidify the top edge of the shoe upper and provide a smooth surface to facilitate movement of the heel portion of the foot into the shoe, said sheet member being constructed of stiff but flexible plastic material and being of one piece construction, said securing means also including a double faced adhesive strip on both outer side surfaces of said plastic sheet member, said sheet member including a lower edge with spaced parallel lines indicating lines of severance for varying the height of the insert to fit different sizes of shoes.

2. In combination with a complete, wearable shoe having an upper including a heel engaging area provided with an upper edge portion subject to forward rolling or folding movement when a foot is inserted into the shoe without the use of a shoe horn, said shoe also including a heel seat and a supporting heel, an insert comprising a sheet member of stiff but flexible plastic material inserted into the heel engaging area of the upper and conforming therewith and reinforcing the heel engaging area, said insert including a reversely folded top edge portion forming a downwardly facing external channel telescopically receiving the upper edge portion of the heel engaging area of the shoe to provide reinforcement to the upper edge portion of the heel engaging area and a continuous smooth surface to facilitate the insertion of the heel portion of the foot into the shoe when the shoe is being placed on the foot without the use of a shoe horn thereby preventing forward rolling or folding movement of the upper edge portion of the heel engaging area of the shoe, said insert having a lower edge engaging the heel seat and terminating at the juncture between the heel seat and the heel engaging area of the upper to prevent the insert from being pushed downwardly, said insert having generally vertically disposed forward edges located adjacent the mid-portion of the length of the heel seat and heel and a generally horizontal downwardly facing lower edge.

3. The combination as defined in claim 2 together with means securing the sheet member to the heel engaging area of the shoe including adhesive means on the exterior surface of the sheet member for securing the outer surfaces of the sheet member to the inner surface of the heel engaging area of the shoe, said sheet member including spaced parallel lines adjacent the lower edge enabling severance of the lower edge portion of the insert at predetermined lines for varying the heighth of the insert to fit different sizes of shoes to prevent downward movement of the sheet member for retaining it in place on the heel engaging area, said adhesive means including a double faced adhesive strip generally parallel to and spaced from each forward edge of the sheet member.

* * * * *